US011335484B2

(12) United States Patent
Tomita et al.

(10) Patent No.: US 11,335,484 B2
(45) Date of Patent: May 17, 2022

(54) PERMANENT MAGNET

(71) Applicant: TDK CORPORATION, Tokyo (JP)

(72) Inventors: Masaki Tomita, Tokyo (JP); Ryuji Hashimoto, Tokyo (JP); Takashi Watanabe, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/965,905

(22) PCT Filed: Jan. 29, 2019

(86) PCT No.: PCT/JP2019/002958
§ 371 (c)(1),
(2) Date: Jul. 29, 2020

(87) PCT Pub. No.: WO2019/151244
PCT Pub. Date: Aug. 8, 2019

(65) Prior Publication Data

US 2021/0043344 A1 Feb. 11, 2021

(30) Foreign Application Priority Data

Jan. 30, 2018 (JP) ..... JP2018-014159

(51) Int. Cl.
*H01F 1/059* (2006.01)

(52) U.S. Cl.
CPC ..... *H01F 1/0593* (2013.01)

(58) Field of Classification Search
None
See application file for complete search history.

(56) References Cited

U.S. PATENT DOCUMENTS

2012/0145944 A1* 6/2012 Komuro ..... H01F 41/0293 252/62.51 R
2014/0349099 A1* 11/2014 Kawashita ..... C22C 38/005 428/220
2016/0148734 A1 5/2016 Karimi et al.
2017/0084370 A1 3/2017 Sakuma et al.
2018/0062455 A1* 3/2018 Hagiwara ..... H02K 7/1823
2020/0227186 A1 7/2020 Suzuki

FOREIGN PATENT DOCUMENTS

| | | | | | |
|---|---|---|---|---|---|
| CN | 105555980 | A | | 5/2016 | |
| CN | 105931779 | A | * | 9/2016 | ..... H01F 1/00 |
| JP | H-0613212 | A | * | 1/1990 | ..... H01F 1/00 |
| JP | H-02129339 | A | * | 5/1990 | ..... H01F 1/00 |
| JP | H-0982510 | A | * | 9/1995 | ..... H01F 1/00 |
| JP | 2008305878 | A | * | 12/2008 | ..... H01F 1/00 |
| JP | 2017-057471 | A | | 3/2017 | |
| JP | 2018-125512 | A | | 8/2018 | |
| WO | 2017/033297 | A1 | | 3/2017 | |
| WO | 2018/123988 | A1 | | 7/2018 | |

OTHER PUBLICATIONS

Machine Translation of JPH0982510A (Year: 1995).*
Machine Translation of JPH-02129339-A (Year: 1990).*
Machine Translation of JP-2008305878-A (Year: 2008).*
Machine Translation of CN-105931779-A (Year: 2016).*
Machine Translation of JPH-0613212-A (Year: 1990).*
Apr. 16, 2019 Search Report issued in International Patent Application No. PCT/JP2019/002958.

* cited by examiner

*Primary Examiner* — Paul A Wartalowicz
*Assistant Examiner* — Ryan L Heckman
(74) *Attorney, Agent, or Firm* — Oliff PLC

(57) ABSTRACT

A permanent magnet including R and T. R are rare earth elements including Sm and at least one selected from Y and Gd. T is Fe alone or Fe and Co. T maybe partly substituted with M, and M is one or more selected from Ti, V, Cr, Mo, W, Zr, Hf, Nb, Ta, Al, Si, Cu, Zn, Ga and Ge. In a total content of R, Sm content is 60 at % or more and 95 at % or less, and a total content of Y and Gd is 5 at % or more and 35 at % or less. The permanent magnet includes main phase crystal grains having a $ThMn_{12}$ type crystal structure.

8 Claims, No Drawings

PERMANENT MAGNET

TECHNICAL FIELD

The invention relates to a permanent magnet.

BACKGROUND

The production of R-T-B based permanent magnets, which is a typical high-performance permanent magnet, has been increasing year by year due to their high magnetic properties. The R-T-B based permanent magnets are used for various purposes, such as various motors, various actuators, and MRI devices, etc. Here, R is at least one of rare earth elements, T is Fe or Fe and Co, and B is boron.

At present, development of a permanent magnet having a $ThMn_{12}$ type crystal structure is underway with the aim of obtaining a permanent magnet having a particularly high magnetic anisotropy. In particular, a high-performance permanent magnet can be obtained when Sm is used as the rare earth element. However, a $ThMn_{12}$ type crystal structure has low stability. Therefore, it was difficult to put the permanent magnet having a $ThMn_{12}$ type crystal structure into practical use.

For example, Patent Document 1 discloses the ferromagnetic alloy having an intermediate crystal structure of $ThMn_{12}$ type crystal structure and $TbCu_7$ type crystal structure. The ferromagnetic alloy has a large magnetic anisotropy. Further, Patent Document 2 discloses the magnetic compound having $ThMn_{12}$ type crystal structure in which Sm is partly substituted with Zr.

The magnetic compound has a large magnetic anisotropy and large residual magnetic density.

[Patent Document 1] WO 2017/033297

[Patent Document 2] Japanese Unexamined Patent Application Publication No. 2017-057471

SUMMARY

An object of the invention is particularly to provide a permanent magnet having high coercive force: HcJ and high residual magnetic flux density: Br.

To achieve the above object, the inventors found that high HcJ and high Br can be obtained by setting a composition of the permanent magnet to a specific composition, as a result of intensive research on the permanent magnet having the $ThMn_{12}$ type crystal structure.

The first viewpoint of the invention is a permanent magnet including R and T, in which R are rare earth elements including Sm and at least one selected from Y and Gd, T is Fe alone or Fe and Co, Sm content is 60 at % or more and 95 at % or less and a total content of Y and Gd is 5 at % or more and 35 at % or less in a total content of R, and the permanent magnet includes main phase crystal grains having a $ThMn_{12}$ type crystal structure.

The second viewpoint of the invention is a permanent magnet including R and T, in which R are rare earth elements including Sm and at least one selected from Y and Gd, T is Fe alone or Fe and Co, T is partly substituted with M, M is one or more selected from Ti, V, Cr, Mo, W, Zr, Hf, Nb, Ta, Al, Si, Cu, Zn, Ga and Ge, and Sm content is 60 at % or more and 95 at % or less and a total content of Y and Gd is 5 at % or more and 35 at % or less in a total content of R, and the permanent magnet includes main phase crystal grains having a $ThMn_{12}$ type crystal structure.

The permanent magnet of the invention shows the above-mentioned properties, so that high HcJ and high Br can be obtained.

The permanent magnet of the invention may have a composition of $(R1_{a/100}R2_{b/100}R3_{c/100})(Fe_{(100-d)/100}Co_{d/100})_xM_y$, in which R1 is Sm, R2 is one or more selected from Y and Gd, R3 is one or more selected from rare earth elements besides R1 and R2, and M is one or more selected from Ti, V, Cr, Mo, W, Zr, Hf, Nb, Ta, Al, Si, Cu, Zn, Ga and Ge, having atomic ratios of $60 \le a \le 95$, $5 \le b \le 35$, $0 \le c \le 20$, $0 \le d \le 50$, $10.0 \le x \le 12.0$, $0 \le y \le 2.0$, $a+b+c=100$, and $10.0 \le x+y \le 12.0$.

M maybe one or more selected from Ti and V, and the atomic ratio maybe $0<y \le 2.0$.

R3 maybe one or more selected from Ce and Pr, and the atomic ratio maybe $0<c \le 20$.

The area ratio of the main phase crystal grains satisfying $0.1\ \mu m \le Dv \le 20\ \mu m$ and $0.7 \le (Di/Dv) \le 2.0$ maybe 70% or more in which a grain size of each of the main phase crystal grains is Di and an average grain size of the main phase crystal grains is Dv in a cut section obtained by cutting the permanent magnet.

DETAILED DESCRIPTION

Hereinafter, embodiments of the invention will be described below.

The First Embodiment

The permanent magnet of the embodiment is the permanent magnet including R and T, in which R are rare earth elements including Sm and at least one selected from Y and Gd, T is Fe alone or Fe and Co, Sm content is 60 at % or more and 95 at % or less and a total content of Y and Gd is 5 at % or more and 35 at % or less in a total content of R, and the permanent magnet includes main phase crystal grains having a $ThMn_{12}$ type crystal structure.

The permanent magnet of the embodiment may include crystal grains having $RT_{12}$ crystal phase of $ThMn_{12}$ type crystal structure, as main phase crystal grains. The permanent magnet may also include crystal structures other than $ThMn_{12}$ type crystal structure. Other phases that do not have $ThMn_{12}$ type crystal structure are considered as different phases, and examples of the different phases include such as $RT_2$ type crystal phase, $RT_3$ type crystal phase, $R_2T_7$ type crystal phase, $RT_5$ type crystal phase, $RT_7$ type crystal phase, $R_2T_{17}$ type crystal phase, $R_5T_{17}$ type crystal phase, etc. Further, the different phase may include an R or T oxide phase, an α-Fe phase, or a rare earth-rich phase. The different phase may be amorphous having no crystal structure.

The main phase is the phase having the highest volume ratio among the permanent magnets. In the permanent magnet of the embodiment, the ratio of the crystal grains having the $RT_{12}$ crystal phase of $ThMn_{12}$ type crystal structure in the whole permanent magnet, that is, the ratio of the main phase crystal grains is 75% or more, and preferably, 85% or more by volume ratio. In addition, the fact that the main phase crystal grains have a $ThMn_{12}$ type crystal structure and the types of different phases can be both confirmed by using such as SEM-EDS, electron diffraction analysis, XRD, etc.

In the permanent magnet according to the embodiment, R are rare earth elements in which Sm is included and at least one selected from Y and Gd is included. Further, relative to the total content of R, Sm content is 60 at % or more and 95 at % or less, and the total content of Y and Gd is 5 at % or more and 35 at % or less. By adding Y and Gd in an amount of 5 at % or more and 35 at % or less, abnormal grain growth is suppressed, HcJ is improved, and Br (residual magnetization) is also improved during manufacturing described later, particularly during heat treatment. However, if Sm is excessively small, the grain size of the main phase crystal grains described later varies greatly, and HcJ decreases. Further, when the total content of Y and Sm is excessively large, the dispersion of the grain size of the main phase crystal grains described later becomes large and HcJ is decreased.

Further, R may contain rare earth elements besides Sm, Y and Gd. The total content of rare earth elements besides Sm, Y and Gd with respect to the total content of R is preferably 0 at % or more and 20 at % or less. When it exceeds 20 at %, the dispersion of the grain size of the main phase crystal grains described later, becomes large and HcJ decreases. The rare earth element besides Sm, Y and Gd is preferably one or more selected from Ce and Pr.

In the permanent magnet according to the embodiment, T is Fe alone or Fe and Co. Further, T is preferably Fe and Co rather than Fe alone because the magnetic properties at room temperature improve. Specifically, Co content to the total content of T is preferably 0 at % or more and 50 at % or less, and more preferably 15 at % or more and 30 at % or less. T may be partly substituted with transition metal elements besides Fe and Co (excluding rare earth elements). The content of transition metal elements (excluding rare earth elements) is 3 at % or less when the total content of T (Fe alone or Fe and Co) is 100 at %.

The permanent magnet of the embodiment preferably has a composition of $(R1_{a/100}R2_{b/100}R3_{c/100})(Fe_{(100-d)/100}Co_{d/100})_x$, in which R1 is Sm, R2 is one or more selected from Y and Gd, and R3 is one or more selected from rare earth elements besides R1 and R2, having atomic ratios of $60 \le a \le 95$, $5 \le b \le 35$, $0 \le c \le 20$, $0 \le d \le 50$, $a+b+c=100$, and $10.0 \le x \le 12.0$.

The permanent magnet of the embodiment has the above composition; thus, HcJ and Br can be further improved. In particular, it is preferable that $0<c \le 20$, and R3 is at least one selected from Ce and Pr.

The permanent magnet of the embodiment sets $10.0 \le x \le 12.0$. If x is excessively large, an amount of α-Fe phase increases and HcJ decreases. If x is excessively small, it becomes difficult to obtain $ThMn_{12}$ type crystal structure, and different phases other than $RT_{12}$ crystal phase increase. Therefore, the content of the main phase (main phase crystal grains) is likely to be low, and HcJ is likely to be low.

Further, according to the permanent magnet of the embodiment, when grain size of each main phase crystal grain in an arbitrary cross section is Di and the average grain size of the main phase crystal grains is Dv, it is preferable that an area ratio of the main phase crystal grains satisfying $0.1\ \mu m \le Dv \le 20\ \mu m$ and $0.7 \le (Di/Dv) \le 2.0$ is 70% or more. The area ratio of the main phase crystal grains satisfying $0.7 \le (Di/Dv) \le 2.0$ is preferably 80% or more, and more preferably 90% or more.

The smaller Dv makes it easier to improve HcJ. The smaller the Dv, the more difficult the manufacturing becomes, and the manufacturing cost tends to increase. Further, HcJ tends to lower when Dv is excessively large.

The main phase crystal grains satisfying $0.7 \le (Di/Dv) \le 2.0$ are the main phase crystal grains having a small difference in grain size from the average grain size. It can be said that the larger the area ratio of the main phase crystal grains having a smaller difference in grain size from the average grain size, the smaller the variation in grain size of the main phase crystal grains. HcJ and Br can be further improved due to the small variation in the grain size of the main phase crystal grains.

The area ratio of the main phase crystal grains satisfying $0.7 \le (Di/Dv) \le 2.0$ is the area ratio to a total cross section of the permanent magnet including the different phases existing between the main phase crystal grains and the main phase crystal grains. Further, in calculating the area ratio of the main phase crystal grains satisfying $0.7 \le (Di/Dv) \le 2.0$, the size of any cross section is arbitrary, but the cross section has a size that includes at least 100 main phase crystal grains.

The method for measuring the area ratio of the main phase crystal grains satisfying $0.7 \le (Di/Dv) \le 2.0$ is arbitrary. For example, by observing the arbitrary cross section with SEM, TEM, etc. and measuring the grain size Di of each main phase crystal grain, the area ratio of the main phase crystal grains satisfying $0.7 \le (Di/Dv) \le 2.0$ is calculated. The grain size Di of each main phase crystal grain is a circle equivalent diameter. The circle equivalent diameter here is the diameter of a circle having the same area as the cross-sectional area of each main phase crystal grain.

The method of manufacturing the permanent magnet according to the embodiment will be described below. Generally, the method of manufacturing the permanent magnet include such as a sintering method, a super-quenching solidification method, a vapor deposition method, an HDDR method, and a strip casting method. Hereinafter, the method of manufacturing by the super-quenching solidification method and the method of manufacturing by the strip casting method will be described in detail, but the other methods may be used for manufacturing.

First, the method of manufacturing the permanent magnet by the super-quenching solidification method will be described. As a concrete super-quenching solidification method, there are a single roll method, a twin roll method, a centrifugal quenching method, a gas atomizing method, etc. The single roll method will be described in the embodiment.

First, a method for manufacturing a quenched alloy thin ribbon by a single roll method is described. First, a raw material alloy having a desired compositional ratio is prepared. The raw material alloy can be prepared by a high-frequency melting the raw material, in which Sm, Fe, etc. are blended to show the compositional ratio of the embodiment, in an inert gas, preferably in an Ar atmosphere. Alternatively, the raw material alloy can be prepared by the other known melting method.

Next, the raw material alloy melt in a furnace, in which pressure was reduced to 50 kPa or less under an Ar atmosphere and become a molten metal. Then, the molten metal injects to the cooling roll, and prepare a quenched alloy thin ribbon. The material of the cooling roll is arbitrary, and for example, a copper roll can be used.

The quenched alloy thin ribbon is composed of an amorphous phase, a mixed phase of an amorphous phase and a crystalline phase, or a crystalline phase. Then, the amorphous phase is finely crystallized by the crystallization treatment. Generally, if the peripheral speed of the cooling roll becomes fast, the amorphous phase increases, the ratio of the fine crystals after the crystallization treatment increases, the Dv becomes small, and the area ratio of the main phase crystal grains satisfying $0.7 \leq (Di/Dv) \leq 2.0$ increases. In the embodiment, the peripheral speed of the cooling roll is preferably 10 m/sec or more and 100 m/sec or less. If the peripheral speed of the cooling roll is excessively slow, there is a tendency that a crystal phase is likely to be generated before the heat treatment, Dv becomes large, and the area ratio of main phase crystal grains satisfying $0.7 \leq (Di/Dv) \leq 2.0$ becomes small. Further, if the peripheral speed of the cooling roll is excessively high, the adhesion between the molten metal and the cooling roll is reduced, and it tends to be difficult to cool the molten metal.

By subjecting the quenched alloy thin ribbon to an optimum heat treatment (crystallization treatment), high magnetic properties are exhibited, and a thin ribbon-shaped permanent magnet (hereinafter sometimes simply referred to as a quenched thin ribbon magnet) is obtained. The conditions of the above heat treatment are arbitrary. For example, it can be performed by maintaining the temperature at 600° C. or higher and 1000° C. or lower for 1 minute or longer. Here, the main phase ratio is high when the heat treatment temperature is high, which is preferable. On the other hand, if the heat treatment temperature is excessively high, abnormal grain growth is likely to occur, and variations in crystal grain size are likely to increase. That is, the heat treatment temperature is preferably high enough to prevent abnormal grain growth.

In the composition of the raw material alloy, by partly substituting Sm with at least one selected from Y and Gd, abnormal grain growth is suppressed even if the heat treatment temperature is high. Then, it is possible to obtain a quenched thin ribbon magnet having a large area ratio of main phase crystal grains satisfying $0.7 \leq (Di/Dv) \leq 2.0$, and particularly excellent HcJ.

When R only includes Sm and heat treatment is carried out at a high temperature (about 900 to 1000° C.), it tends to have a fine structure in which the main phase crystal grains which are abnormally grain-grown to about several μm and the main phase crystal grains having the crystal grain size of several tens to several hundred μm are mixed. Thus, if the crystal grain size of the main phase crystal grains has a large variation, the magnetization reversal starts in a magnetic field smaller than the original HcJ, which causes a decrease in HcJ. Further, a different phase is likely to be generated and the main phase ratio is lowered, so that the residual magnetization is reduced. On the other hand, when Sm is partly replaced with one or more selected from Y and Gd, abnormal grain growth is unlikely to occur, and a fine structure composed of uniform fine crystals is likely to be formed.

A bulk permanent magnet can be manufactured from the obtained quenched thin ribbon magnet. The method of manufacturing can be appropriately selected depending on the intended use and shape of the permanent magnet. For example, there are methods such as by sintering, hot-forming, etc. Alternatively, a bond magnet can be obtained by solidifying and compacting with a resin binder.

A method of manufacturing the bulk permanent magnet by hot-processing will be described below. When producing the bulk permanent magnet by hot-processing, it is desirable to use a permanent magnet powder including fine main phase crystal grains having a crystal grain size of several tens to several hundreds of nm. First, the quenched thin ribbon magnet is pulverized to obtain a powder of a permanent magnet. The pulverization is preferably performed in two stages of coarse pulverization and fine pulverization, however, may be performed in only one stage of fine pulverization. In the following description, the powder of the permanent magnet may be simply referred to as coarse powder or fine powder.

The method of coarse pulverization is optional. For example, there are methods such as using a ball mill, a stamp mill, a jaw crusher, a brown mill, etc., and a method using a hydrogen pulverization treatment is also available. Whatever method is used, it is common to obtain a coarse powder by pulverizing so that the pulverized grain size is about several tens to several hundreds of μm.

The method of fine pulverization is arbitrary. For example, there are a dry pulverization method using a jet mill and a wet pulverization method using a bead mill. Further, there is also a method of performing dry pulverization and then wet pulverization. Fine pulverization is particularly preferably performed in an inert atmosphere to prevent deterioration of magnetic properties due to oxidation or nitriding. Finally, a fine powder having a pulverized grain size of several μm to 20 μm is obtained.

Particularly when dry pulverizing using the jet mill, the pulverized fine powder tends to re-aggregate or adhere to the container wall because of extremely high activity of the fine powder surface after pulverization, and the yield tends to decrease. Therefore, it is preferable to add a grinding aid such as zinc stearate or oleic acid amide. The additional amount of the pulverization aid varies depending on such as the target grain size of the fine powder, the type of the pulverization aid, etc, but is preferably around 0.1 mass % or more and 1 mass % or less. Further, in the case of dry pulverization using a jet mill, it is preferable to use a device equipped with a classifier. By using the device equipped with classifier, it is possible to remove coarse powder and ultrafine powder and to re-pulverize, and it becomes easy to reduce variations in pulverized grain size.

Next, the fine powder is pressed to obtain a green compact. The pressing method is arbitrary, and a generally used method can be used. For example, there is a method in which the fine powder is charged into a mold and pressed using a pressing machine.

Next, the green compact is sintered to obtain a sintered body. The sintering method is arbitrary, and a generally used method can be used. For example, a spark plasma sintering method (SPS method), a hot pressing method by high-frequency heating, and a hot pressing method by light concentrating and heating are mentioned. SPS method, the hot pressing method by high-frequency heating, and the hot pressing method by light concentrating and heating are preferable in that the main phase crystal grains can be prevented from coarsening in the process of raising temperature, since the methods are capable of rapidly raising the temperature of the green compact to a desired sintering temperature. In particular, it is possible to sinter at a relatively low temperature when SPS method is used for sintering. Therefore, when the method of sintering by SPS method is used, the main phase crystal grains are relatively unlikely to grow, and the production stability is high.

The sintering temperature may be appropriately selected depending on such as alloy composition. In general, the temperature is preferably 650° C. to 750° C., more preferably 700° C. to 750° C. The sintering time is easily shortened when the temperature is 650° C. or higher, and the sintering time is further easily shortened when the temperature is 700° C. or higher. It becomes easy to prevent the main phase crystal grains from coarsening during the sintering by setting the temperature to 750° C. or lower.

To prevent the green compact from being deformed due to expansion during sintering, it is preferable to press the lid of the mold containing the green compact at 100 MPa to 500 MPa. Deformation due to expansion can be prevented when the pressure is 100 MPa or more. It is possible to prevent the green compact from being plastically deformed by the above pressure during sintering when the pressure is 500 MPa or less. The atmosphere during sintering is preferably an inert gas, such as an Ar gas, atmosphere.

Next, the hot-processing is performed to compress the obtained sintered body at 700° C. to 1000° C. to obtain a hot-processed magnet. By setting the hot-processing temperature to 700° C. or higher, the sintered body is easily deformed and easily compressed. As a result, an axis of easy magnetization will be oriented in a direction parallel to the compression direction and becomes possible to obtain a hot-processed magnet having high anisotropy. On the other hand, by setting the hot-processing temperature to 1000° C. or less, coarsening of the main phase crystal grains can be prevented, and HcJ and Br can be maintained high. In addition, an excessive deformation of the sintered body can be prevented, and damage when the sintered body is compressed and deformed can be prevented. The hot-processing temperature is more preferably 800° C. to 900° C. The atmosphere during hot-processing is preferably an inert gas, such as an Ar gas, atmosphere.

Next, a method of manufacturing a permanent magnet by a strip casting method, and a manufacturing method of an anisotropic sintered magnet will be described.

When a bulk permanent magnet is manufactured by sintering, the isotropic sintered magnet can be produced by a known method using the fine powder of the quenched thin ribbon magnet described above.

However, the fine powder produced by the super-quenching solidification method includes fine main phase crystal grains having crystal grain size of several tens to several hundreds nm tends to show magnetic domain structure of multi-domain. Therefore, when using fine powder including fine main phase crystal grains having a grain size of several tens to several hundreds of nm, it is difficult to manufacture the anisotropic sintered magnet through a step of molding the fine powder in a magnetic field. Instead, it is desirable to use fine powder including large main phase crystal grains having a crystal grain size of approximately 1 μm or more. The fine powder including large main phase crystal grains having a crystal grain size of about 1 μm or more is manufactured by, for example, the strip casting method.

First, the molten metal having the desired compositional ratio is prepared. The molten metal can be prepared by high-frequency melting of raw materials, in which Sm, Fe, etc. are blended to have the compositional ratio according to the embodiment, in an inert atmosphere such as vacuum or Ar atmosphere. The method for manufacturing the molten metal is not limited to the above method, and the other known melting methods can be used.

Next, the molten metal was quenched by charging into the cooling roll of any material, such as copper roll, crushed and collected as it is. It is possible to change the cooling rate by controlling the temperature of the cooling roll before the molten metal is poured, for example, within the range of 200 to 600° C. Although the peripheral speed of the cooling roll is arbitrary, a crystal grain size larger than that of the permanent magnet manufactured by the super-quenching solidification method can be obtained by setting the cooling rate slower than that of the above-mentioned super quenching solidification method.

Next, it is possible to manufacture a uniform structure or a desired crystal phase by performing heat treatment to the alloy obtained by crushing and collecting. Although the heat treatment conditions are arbitrary, for example, the heat treatment may be performed at 800° C. or more and 1300° C. or less in an inert atmosphere, such as vacuum or Ar atmosphere.

Next, the pulverization is performed. The pulverization may be two-stage pulverization of coarse pulverization and fine pulverization or may be one-stage pulverization of only fine pulverization.

The method of coarse pulverization is arbitrary. The coarse pulverization may be performed by a ball mill, a stamp mill, a jaw crusher, a brown mill, etc., or hydrogen storage pulverization may be performed. In the case of the hydrogen storage pulverization, the coarse pulverization can be performed by storing hydrogen and then releasing the hydrogen by heating in an inert atmosphere. The coarse pulverization is performed until the pulverized grain size reaches about several tens to several hundreds of The method of fine pulverization is also arbitrary. For example, there are a dry pulverization method using jet mill and a wet pulverization method using a bead mill. Further, there is also a method of performing dry pulverization and then wet pulverization. The fine pulverization is particularly preferably performed in an inert atmosphere to prevent deterioration of magnetic properties due to oxidation or nitriding. Fine powder having a pulverized grain size of several μm to 20 μm is eventually obtained.

After going through the above steps, it is possible to obtain fine powder including large main phase crystal grains having grain size of approximately 1 μm or more.

Next, in the case of obtaining the anisotropic sintered magnet after sintering, the obtained fine powder is pressed in a magnetic field to form a green compact. In concrete, after the fine powder is filled in a mold disposed in an electromagnet, the fine powder is pressured and formed while applying magnetic field to the fine powder by the electromagnet and orientating the crystal axes of the fine powder. Although the magnitude of the magnetic field is arbitrary, it is set to e.g. around 1.0 T to 1.5 T. Although the magnitude of the pressure during pressurization is arbitrary, it is set to e.g. around 50 MPa to 200 MPa. If the magnetic field is not applied in the pressing step, an isotropic sintered magnet can be obtained after sintering.

Then, a sintered body (sintered magnet) is obtained by sintering the obtained green compact. The sintering method is arbitrary, however, it is important to perform sintering while keeping the grain size distribution of the fine powder small. That is, it is important to sinter while keeping the variation in crystal grain size in the fine powder small. Therefore, it is preferable that the atmosphere during sintering is an inert atmosphere and the sintering temperature is about 900° C. to 1200° C., and it may be about 900° C. to 1100° C. The sintering time is preferably about 0.05 hour to 10 hours. By setting the sintering temperature and the sintering time within the above range, the grain growth of the main phase crystal grains is suppressed and the variation in grain size is reduced. Then, the anisotropic sintered magnet having high HcJ and high Br can be obtained. If the sintering temperature is excessively low and/or the sintering time is excessively short, the density of the sintered magnet tends to decrease, and Br tends to significantly decrease. If the sintering temperature is excessively high or the sintering time is excessively long, the grain growth of the main phase crystal grains will be excessively promoted and the variation in grain size will increase. Further, the $ThMn_{12}$ type crystal structure may be decomposed. Then, HcJ and/or Br tend to decrease. Br tends to be improved when the above described magnetic field orientation pressing is performed, as compared with the case where the magnetic field orientation molding is not performed.

The steps from pulverizing to sintering are preferably carried out in an inert atmosphere, such as vacuum or Ar atmosphere. By carrying out in an inert atmosphere, it becomes easy to prevent oxidation and nitridation of rare earth elements in the alloy. If oxides or nitrides of rare earth elements are produced, the volume ratio of the main phase crystal grains is reduced, and Br is lowered.

The Second Embodiment

Hereinafter, the second embodiment will be described, however, the description part common to that of the first embodiment is omitted.

The permanent magnet of the embodiment is a permanent magnet including R and T, in which R are rare earth elements including Sm and at least one selected from Y and Gd, T is Fe alone or Fe and Co, T is partly substituted with M, M is one or more selected from Ti, V, Cr, Mo, W, Zr, Hf, Nb, Ta, Al, Si, Cu, Zn, Ga and Ge, and Sm content is 60 at % or more and 95 at % or less and a total content of Y and Gd is 5 at % or more and 35 at % or less in a total content of R, and the permanent magnet comprises main phase crystal grains having a $ThMn_{12}$ type crystal structure.

The difference from the first embodiment is that T is partly substituted with M. By partly substituting T with M, it has an effect of stabilizing $ThMn_{12}$ type crystal structure included in the main phase crystal grains and makes it easy to obtain a single phase of $ThMn_{12}$ type crystal structure. And, it has an effect of suppressing the decomposition of the $ThMn_{12}$ type crystal structure particularly when manufacturing a sintered magnet or a hot-processed magnet.

M is preferably one or more selected from Ti, V, W and Nb, M is more preferably one or more selected from Ti and V, M is the most preferably Ti.

The permanent magnet of the embodiment preferably has a composition of $(R1_{a/100}R2_{b/100}R3_{c/100})(Fe_{(100-d)/100}Co_{d/100})_xM_y$, wherein R1 is Sm, R2 is one or more selected from Y and Gd, R3 is one or more selected from rare earth elements besides R1 and R2, and M is one or more selected from Ti, V, Cr, Mo, W, Zr, Hf, Nb, Ta, Al, Si, Cu, Zn, Ga and Ge, having atomic ratios of $60 \le a \le 95$, $5 \le b \le 35$, $0 \le c \le 20$, $0 \le d \le 50$, $10.0 \le x \le 12.0$, $0 < y \le 2.0$, $a+b+c=100$, and $10.0 \le x+y \le 12.0$.

The permanent magnet of the embodiment having the above composition can further improve HcJ and Br. Further, it becomes easy to improve the magnetic properties by setting $0 \le y \le 2.0$ and setting M to one or more selected from Ti and V.

$10.0 \le x+y \le 12.0$ is set in the permanent magnet of the embodiment. When x+y is excessively large, the amount of α-Fe increases and HcJ decreases. When x+y is excessively small, it becomes difficult to obtain $ThMn_{12}$ type crystal structure, and the number of different phases other than $RT_{12}$ crystal phase increases. Therefore, the content of the main phase (main phase crystal grains) tends to be low, and HcJ tends to be low.

Although T may be partly substituted with transition metal elements (excluding rare earth elements) besides Fe, Co and M, the content of transition metal elements (excluding rare earth elements) besides Fe, Co and M is 3.0 at % or less when the total content of T (Fe alone or Fe and Co) and M is 100 at %.

The following composition is a combination of a composition including the preferable composition of the first embodiment and the same of the second embodiment.

$(R1_{a/100}R2_{b/100}R3_{c/100})(Fe_{(100-d)/100}Co_{d/100})_xM_y$, wherein

R1 is Sm,

R2 is one or more selected from Y and Gd,

R3 is one or more selected from rare earth elements other than R1 and R2, and

M is one or more selected from Ti, V, Cr, Mo, W, Zr, Hf, Nb, Ta, Al, Si, Cu, Zn, Ga and Ge, having atomic ratios of $60 \le a \le 95$, $5 \le b \le 35$, $0 \le c \le 20$, $0 \le d \le 50$, $10.0 \le x \le 12.0$, $0 \le y \le 2.0$, $a+b+c=100$, and $10.0 \le x+y \le 12.0$

EXAMPLES

Hereinafter, the contents of the invention will be described in detail with reference to examples and comparative examples, however, the invention is not limited thereto.

(Experiment 1: Quenched Thin Ribbon Magnet)

Method of manufacturing the quenched thin ribbon magnet of Experiment 1 is described. First, raw material powders including Sm, Fe, etc. were blended so that the finally obtained quenched thin ribbon magnet had a composition ratio shown in Table 1. Next, an alloy ingot was prepared by arc melting in an Ar atmosphere and was cut into small pieces using a stamp mill. Then, a single roll method was performed to obtain a quenched alloy thin ribbon having the composition of each Example and Comparative Example from the small piece. Specifically, high-frequency melting was performed in an Ar atmosphere depressurized to 30 kPa to obtain a molten metal, and then the molten metal was sprayed onto a copper roll having a peripheral speed of 80 m/sec to be quenched. Then, heat treatment was performed at 900° C. for 10 minutes. Further, the heat treatment condition of Example 14 was 1200° C. for 5 minutes.

The coarse pulverization was then performed to the obtained quenched thin ribbon magnet. The coarse pulverization was performed with a ball mill, and coarse powder having a pulverized grain size of several tens to several hundreds of μm was obtained.

HcJ and the residual magnetization σr of the obtained coarse powder were measured using VSM. The results are shown in Table 1. In Experiment 1, HcJ exceeding 2.8 kOe was regarded preferable. The residual magnetization σr of 30 emu/g or more was regarded preferable.

According to the Experiment, the average grain size Dv of the main phase crystal grains and the area ratio of the main phase crystal grains satisfying 0.7≤(Di/Dv)≤2.0 were obtained by measuring each grain size of at least 100 main phase crystal grains using SEM and calculating from the measurement results.

According to the Experiment, composition analysis was performed by inductively coupled plasma mass spectrometry method (ICP-MS method) for all the examples and comparative examples. As a result, it was confirmed that each of the quenched thin ribbon magnets had the composition shown in Table 1. Further, the crystal structure of the main phase crystal grains was confirmed by using the X-ray diffraction method (XRD). As a result, it was confirmed that the main phase crystal grains had $ThMn_{12}$ type crystal structure in each of the Examples and Comparative Examples.

main phase crystal grains satisfying 0.7≤(Di/Dv)≤2.0 were different. Then, Example 2, in which the area ratio of the main phase crystal grains satisfying 0.7≤(Di/Dv)≤2.0 is 80% or more (96%), showed excellent residual magnetization σr and HcJ as compared with those of Example 14, in which the area ratio of the main phase crystal grains satisfying 0.7≤(Di/Dv)≤2.0 is less than 80% (70%).

(Experiment 2: Hot-Processed Magnet) 0.5 mass % of oleic acid amide as a pulverization aid were added and mixed to the course powder obtained from Example A of Experiment 1, and then fine pulverization was performed using a jet mill. By changing the classification conditions of the jet mill, the pulverized grain size of the fine powder was set to about several μm. The oxygen concentration in the Ar atmosphere during fine pulverization was set to 100 ppm or less.

Then, fine powder thus obtained was charged into a mold to obtain a green compact. The obtained green compact was sintered with the hot pressing method by high-frequency heating to obtain the sintered body. The sintering temperature was 750° C., and the sintering was performed in an Ar atmosphere. The green compact was pressed at 500 MPa during sintering.

Next, the obtained sintered body was subjected to hot-processing to compress while heating at the forming temperatures shown in Table 2, to obtain a hot-processed magnet. Then, the densities of the obtained hot-processed magnets (Examples 16 to 18 in Table 2 below) were measured to calculate the relative densities, and then the magnetic properties thereof were measured using a pulse BH tracer. The area ratio of the main phase crystal grains

TABLE 1

| | Compositions | Dv (μm) | An area ratio (%) of the main phase crystal grains satisfying 0.7 ≤ (Di/Dv) ≤ 2.0 | HcJ (kOe) | σr (emu/g) |
|---|---|---|---|---|---|
| Example 1 | (Sm0.8Y0.2)Fe11.0Ti0.5 | 0.16 | 93 | 4.0 | 69.3 |
| Example A | (Sm0.8Y0.2)(Fe0.75Co0.25)11.0Ti0.5 | 0.16 | 96 | 4.2 | 72.9 |
| Example B | (Sm0.8Y0.2)(Fe0.75Co0.25)9.5Ti0.5 | 0.16 | 96 | 3.3 | 68.4 |
| Example 2 | (Sm0.8Y0.2)(Fe0.75Co0.25)11.5Ti0.5 | 0.16 | 96 | 4.1 | 71.5 |
| Example 3 | (Sm0.95Y0.05)(Fe0.75Co0.25)11.0Ti0.5 | 0.18 | 86 | 3.3 | 68.1 |
| Example 4 | (Sm0.65Y0.35)(Fe0.75Co0.25)11.0Ti0.5 | 0.12 | 92 | 3.4 | 67.7 |
| Example 5 | (Sm0.8Gd0.2)(Fe0.75Co0.25)11.0Ti0.5 | 0.20 | 81 | 4.5 | 62.5 |
| Example 6 | (Sm0.8Y0.1Gd0.1)(Fe0.75Co0.25)11.0Ti0.5 | 0.18 | 83 | 3.8 | 66.0 |
| Example 7 | (Sm0.6Y0.2Ce0.2)(Fe0.75Co0.25)11.0Ti0.5 | 0.22 | 80 | 3.3 | 64.9 |
| Example 8 | (Sm0.6Y0.2Pr0.2)(Fe0.75Co0.25)11.0Ti0.5 | 0.20 | 81 | 3.7 | 67.1 |
| Example 9 | (Sm0.8Y0.2)(Fe0.5Co0.5)11.0Ti0.5 | 0.18 | 85 | 4.1 | 67.8 |
| Example 10 | (Sm0.8Y0.2)(Fe0.75Co0.25)11.2Ti0.3 | 0.16 | 85 | 2.9 | 75.2 |
| Example 11 | (Sm0.8Y0.2)(Fe0.75Co0.25)10.5Ti | 0.24 | 83 | 5.1 | 61.3 |
| Example 12 | (Sm0.8Y0.2)(Fe0.75Co0.25)10.5V | 0.26 | 86 | 4.3 | 52.2 |
| Example 13 | (Sm0.8Y0.2)(Fe0.75Co0.25)10.0V1.5 | 0.26 | 84 | 5.6 | 46.6 |
| Example 14 | (Sm0.8Y0.2)(Fe0.75Co0.25)11.0Ti0.5 | 0.28 | 70 | 3.3 | 69.0 |
| Comp. Ex. 1 | SmFe11.0Ti0.5 | 0.30 | **55** | **2.8** | 58.8 |
| Comp. Ex. A | SmFe9.0Ti0.5 | 0.35 | **48** | **0.9** | 38.7 |
| Comp. Ex. B | SmFe12.0Ti0.5 | 0.30 | **56** | **1.3** | 44.5 |
| Comp. Ex. 2 | Sm(Fe0.75Co0.25)11.0Ti0.5 | 0.30 | **57** | **2.8** | 64.1 |
| Comp. Ex. 3 | (Sm0.6Y0.4)(Fe0.75Co0.25)11.0Ti0.5 | 0.24 | **60** | **2.6** | 53.4 |
| Comp. Ex. 4 | (Sm0.4Y0.2Ce0.4)(Fe0.75Co0.25)11.0Ti0.5 | 0.24 | **60** | **1.8** | 38.2 |

According to Table 1, Examples 1 to 14 and Examples A and B, those having compositions within the predetermined range, showed a preferable HcJ and residual magnetization σr. On the other hand, the coarse powder of Comparative Examples 1 to 4 and Comparative Examples A and B, those having compositions outside the predetermined range, showed lower HcJ compared to the same of Examples.

Further, Examples 2 and 14 conducted under the same conditions except for the heat treatment condition were compared. Since the heat treatment condition was different between Example 2 and Example 14, their area ratio of the satisfying the average grain size Dv and 0.7≤(Di/Dv)≤2.0 were calculated by setting the observing range to a size at which 100 or more main phase crystal grains are visible in the cross section of the obtained hot-processed magnet, and observing thereof using SEM. In the Experiment, H⊥ and H// were both considered preferable when 3.0 kOe or more. Br⊥ and Br// were considered preferable when 7.0 kG or more. The relative density is the ratio of the density measured from the weight and the magnet volume when theoretical density calculated from the composition and the lattice constant of the hot-processed magnet is 100%.

TABLE 2

| | Compositions | Forming Temperature (° C.) | Relative Densities (%) | Dv (μm) | An area ratio (%) of the mam phase crystal grains satisfying 0.7 ≤ (Di/Dv) ≤ 2.0 | H⊥ (kOe) | H// (kOe) | Br⊥ (kG) | Br// (kG) |
|---|---|---|---|---|---|---|---|---|---|
| Example 16 | (Sm0.8Y0.2)(Fe0.75Co0.25)11.0Ti0.5 | 700 | 88 | 0.16 | 91 | 3.6 | 3.6 | 7.4 | 8.2 |
| Example 18 | (Sm0.8Y0.2)(Fe0.75Co0.25)11.0Ti0.5 | 850 | 94 | 0.22 | 86 | 3.3 | 3.3 | 7.2 | 9.6 |
| Example 17 | (Sm0.8Y0.2)(Fe0.75Co0.25)11.0Ti0.5 | 900 | 95 | 0.24 | 84 | 3.2 | 3.2 | 7.0 | 10.1 |

According to Table 2, the hot-processed magnets of Examples 16 to 18 having compositions of predetermined range showed preferable ranges of the average grain size Dv of main phase crystal grains and the area ratio of the main phase crystal grains satisfying 0.7≤(Di/Dv)≤2.0, and HcJ and Br thereof were preferable. Further, HcJ of Example 16, in which the area ratio of the main phase crystal grains satisfying 0.7≤(Di/Dv)≤2.0 was 90% or more, was high as compared with the same of Examples 17 and 18, in which the area ratio of the main phase crystal grains satisfying 0.7≤(Di/Dv)≤2.0 was less than 90%. Furthermore, the orientation (anisotropy) of Br was small in Example 16. In addition, Example 17 shows larger Dv and lower area ratio of the main phase crystal grains satisfying 0.7≤(Di/Dv)≤2.0 as compared with those in Examples 16 and 18. This is considered that it is because forming temperature in Example 17 is high and the main phase crystal grains are partly bonded to each other. Similarly, hot-processed magnets, having the same compositions and mutually different area ratios of the main phase grains satisfying 0.7≤(Di/Dv) ≤2.0, was manufactured by the coarse powder of Examples in Experiment 1, excluding Example A. Thus, manufactured hot-processed magnets exhibited the same tendency as in Examples 16 to 18.

(Experiment 3: Sintered Body)

A permanent magnet having the same composition as in Example A of Experiment 1 was produced using an alloy manufactured by the strip casting method.

First, the raw materials blended to have the same composition ratio as in Example 2 of Experiment 1 were high-frequency melted in an inert atmosphere to prepare a molten metal. Next, the molten metal was poured into a copper roll having a peripheral speed of 1.5 m/s to quench, and then crushed and collected as it was.

Next, the alloy obtained by crushing and collecting was heat-treated at 1000° C. for 1 hour in an Ar atmosphere.

Next, coarse pulverizing and fine pulverizing were performed. The coarse pulverizing was performed by hydrogen pulverizing treatment. Specifically, after storing hydrogen, dehydrogenation was performed in an Ar atmosphere at 500° C. for 1 hour. Then, it was cooled to room temperature under Ar atmosphere, and obtained coarse powder.

The fine pulverization was performed by adding 0.5 mass % of oleic acid amide as a pulverizing aid to the obtained coarse powder, and mixing thereof using a jet mill. By changing the pulverization conditions and classification conditions of the jet mill, the pulverized grain size was made to about several μm in Example 21 and about tens of μm in Example C in Table 3 below. The oxygen concentration in the Ar atmosphere in the coarse pulverization and the fine pulverization was adjusted to 100 ppm or less.

Then, the obtained fine powder was pressed. Specifically, the fine powder is filled in a mold arranged in an electromagnet, and then pressure is applied while applying a magnetic field by the electromagnet to perform pressure forming while orienting the crystal axes of the fine powder to obtain a green body of 10 mm×15 mm×12 mm. The magnitude of the magnetic field was 1.5 T and the magnitude of the pressure was 70 MPa.

Next, the obtained green compact was sintered. In the Experiment, the sintering was carried out at a holding temperature of 1200° C. and a holding time of 4 hours. Then, with respect to the obtained sintered bodies (Example 21 and Example C in Table 3 below), HcJ and Br in the orientation direction were measured using a pulse BH tracer. Furthermore, the relative densities were measured. The area ratio of the main phase crystal grains satisfying the average grain size Dv and 0.7≤(Di/Dv)≤2.0 was calculated by setting an observation range to a size where 100 or more main phase crystal grains are visible in the cross section of the obtained sintered body, and observing by SEM. In the Experiment, it was considered preferable when HcJ in the orientation direction was 3.0 kOe or more. It was considered preferable when residual magnetic flux density Br in the orientation direction was 10.0 kG or more. The relative density is the ratio of the density measured from the weight and the magnet volume, in which the theoretical density calculated from the composition of the sintered body and the lattice constant is 100%.

In the Experiment, composition analysis was performed by inductively coupled plasma mass spectrometry (ICP-MS method). As a result, it was confirmed that the sintered bodies of Example 21 and Example C had the compositions shown in Table 3. Moreover, the crystal structure of the main phase crystal grains of the sintered body was confirmed by using an X-ray diffraction method (XRD). As a result, it was confirmed that the main phase crystal grains had a $ThMn_{12}$ type crystal structure in both Examples.

TABLE 3

| | Compositions | Relative Densities (%) | Dv (μm) | An area ratio (%) of the main phase crystal grains satisfying 0.7 ≤ (Di/Dv) ≤ 2.0 | HcJ (kOe) | Br (kG) |
|---|---|---|---|---|---|---|
| Example 21 | (Sm0.8Y0.2)(Fe0.75Co0.25)11.0Ti0.5 | 95 | 2 | 94 | 3.5 | 13.8 |
| Example C | (Sm0.8Y0.2)(Fe0.75Co0.25)11.0Ti0.5 | 89 | 10 | 88 | 3.0 | 12.4 |

According to Table 3, the sintered bodies of Examples 21 and C those having compositions of predetermined range showed preferable ranges of the average crystal grain size Dv of main phase crystal grains and the area ratio of the main phase crystal grains satisfying 0.7≤(Di/Dv)≤2.0. HcJ and Br thereof were preferable. Example 21, in which the average grain size Dv is relatively small and the area ratio of the main phase crystal grains satisfying 0.7≤(Di/Dv)≤2.0 is 90% or more, showed higher magnetic properties relative to Example C, in which the average grain size Dv is relatively large and the area ratio of the main phase crystal grains satisfying 0.7≤(Di/Dv)≤2.0 is less than 90%. Similarly, sintered bodies, having the same compositions and mutually different average grain size Dv and area ratios of the main phase grains satisfying 0.7≤(Di/Dv)≤2.0, were manufactured by Examples in Experiment 1 other than Example A. Thus, manufactured sintered bodies exhibited the same tendency as in Examples 21 and C.

(Experiment 4: Sintered Body Obtained by Sintering Using SPS Method)

The permanent magnets of the same composition as Example 2 of Experiment 1 was produced by sintering using SPS method.

First, the coarse powder having the same composition as Example 2 of Experiment 1 was prepared. The method for producing the coarse powder is the same as in Experiment 1.

Next, the obtained coarse powder was charged into a carbon mold and subjected to sintering by SPS method. The pressure was 500 MPa and the holding time was 5 minutes. The sintering temperature was changed as shown in Table 4.

The relative density, magnetic properties, average grain size Dv, and area ratio of main phase crystal grains satisfying 0.7≤(Di/Dv)≤2.0 of the sintered body produced by sintering using SPS method were measured. The measurement method is the same as in Experiment 2. In Experiment 4, it was considered preferable when HcJ was 3.0 kOe or more. And it was considered preferable when Br was 6.0 kG or more. The results are shown in Table 4.

TABLE 4

| | Compositions | Sintering Temperature (° C.) | Relative Densities (%) | Dv (μm) | An area ratio (%) of the main phase crystal grains satisfying 0.7 ≤ (Di/Dv) ≤ 2.0 | HcJ (kOe) | Br (kG) |
|---|---|---|---|---|---|---|---|
| Example 31 | (Sm0.8Y0.2)(Fe0.75Co0.25)11.5Ti0.5 | 650 | 88.7 | 0.17 | 84 | 3.3 | 6.0 |
| Example 32 | (Sm0.8Y0.2)(Fe0.75Co0.25)11.5Ti0.5 | 700 | 97.1 | 0.17 | 84 | 3.0 | 6.7 |
| Example 33 | (Sm0.8Y0.2)(Fe0.75Co0.25)11.5Ti0.5 | 750 | 99.5 | 0.18 | 84 | 3.0 | 6.9 |

According to Table 4, the sintered bodies of Examples 31 to 33, obtained by sintering using SPS method those having compositions of predetermined range, showed preferable average grain size Dv of the main phase crystal grains and preferable area ratio of the main phase crystal grains satisfying 0.7≤(Di/Dv)≤2.0. HcJ and Br thereof were also preferable. In addition, as for the coarse powders of Examples other than Example 2 in Experiment 1, sintered bodies having the same compositions, but different sintering temperatures were produced by sintering using the SPS method. The sintered bodies showed the same tendencies as in Examples 31 to 33 were obtained.

What is claimed is:

1. A permanent magnet comprising R and T, wherein R are rare earth elements comprising Sm and at least one selected from Y and Gd, T consists of Fe or Fe and Co, Sm content is 60 at % or more and 95 at % or less with respect to a total content of R and a total content of Y and Gd is 5 at % or more and 35 at % or less with respect to the total content of R, the permanent magnet comprises main phase crystal grains having a $ThMn_{12}$ type crystal structure, and an area ratio of the main phase crystal grains satisfying 0.1 μm≤Dv≤10 μm and 0.7≤(Di/Dv)≤2.0 is 70% or more, where a grain size of each of the main phase crystal grains is Di and an average grain size of the main phase crystal grains is Dv in a cut section obtained by cutting the permanent magnet.

2. A permanent magnet comprising R and T, wherein R are rare earth elements comprising Sm and at least one selected from Y and Gd, T consists of Fe or Fe and Co, T is partly substituted with M, M is one or more selected from Ti, V, Cr, Mo, W, Zr, Hf, Nb, Ta, Al, Si, Cu, Zn, Ga and Ge, and Sm content is 60 at % or more and 95 at % or less with respect to a total content of R and a total content of Y and Gd is 5 at % or more and 35 at % or less with respect to the total content of R, the permanent magnet comprises main phase crystal grains having a $ThMn_{12}$ type crystal structure, and an area ratio of the main phase crystal grains satisfying 0.1 μm≤Dv≤10 μm and 0.7≤(Di/Dv)≤2.0 is 70% or more, where a grain size of each of the main phase crystal grains is Di and an average grain size of the main phase crystal grains is Dv in a cut section obtained by cutting the permanent magnet.

3. The permanent magnet according to claim 1, having a composition of $(R1_{a/100}R2_{b/100}R3_{c/100})(Fe_{(100-d)/100}Co_{d/100})_xM_y$, wherein R1 is Sm, R2 is one or more selected from Y and Gd, R3 is one or more selected from rare earth elements besides R1 and R2, and M is one or more selected from Ti, V, Cr, Mo, W, Zr, Hf, Nb, Ta, Al, Si, Cu, Zn, Ga and Ge, having atomic ratios of 60≤a≤95, 5≤b≤35, 0≤c≤20, 0≤d≤50, 10.0≤x≤12.0, 0≤y≤2.0, a+b+c=100, and 10.0≤x+y≤12.0.

4. The permanent magnet according to claim 3, wherein M is one or more selected from Ti and V, having an atomic ratio of 0<y≤2.0.

5. The permanent magnet according to claim 3, wherein R3 is one or more selected from Ce and Pr, having an atomic ratio of 0<c≤20.

6. The permanent magnet according to claim 2, having a composition of $(R1_{a/100}R2_{b/100}R3_{c/100})(Fe_{(100-d)/100}Co_{d/100})_xM_y$, wherein R1 is Sm, R2 is one or more selected from Y and Gd, R3 is one or more selected from rare earth elements besides R1 and R2, and M is one or more selected from Ti, V, Cr, Mo, W, Zr, Hf, Nb, Ta, Al, Si, Cu, Zn, Ga and Ge, having atomic ratios of $60 \leq a \leq 95$, $5 \leq b \leq 35$, $0 \leq c \leq 20$, $0 \leq d \leq 50$, $10.0 \leq x \leq 12.0$, $0 \leq y \leq 2.0$, $a+b+c=100$, and $10.0 \leq x+y \leq 12.0$.

7. The permanent magnet according to claim 6, wherein M is one or more selected from Ti and V, having an atomic ratio of $0<y \leq 2.0$.

8. The permanent magnet according to claim 6, wherein R3 is one or more selected from Ce and Pr, having an atomic ratio of $0<c \leq 20$.

* * * * *